US007364640B2

(12) United States Patent
Chute et al.

(10) Patent No.: US 7,364,640 B2
(45) Date of Patent: Apr. 29, 2008

(54) CHEMIMECHANICAL DESILICATION OF NONWOOD PLANT MATERIALS

(75) Inventors: Wade Chute, Edmonton (CA); Sofia Vichnevsky, Edmonton (CA)

(73) Assignee: Alberta Research Council Inc., Edmonton, Alberta (CA)

( * ) Notice: Subject to any disclaimer, the term of this patent is extended or adjusted under 35 U.S.C. 154(b) by 44 days.

(21) Appl. No.: 10/711,277

(22) Filed: Sep. 7, 2004

(65) Prior Publication Data

US 2005/0051287 A1 Mar. 10, 2005

Related U.S. Application Data

(60) Provisional application No. 60/481,340, filed on Sep. 8, 2003.

(51) Int. Cl.
*D21C 1/06* (2006.01)
*D21C 3/02* (2006.01)
*D21C 9/18* (2006.01)

(52) U.S. Cl. ..... 162/99; 162/41; 162/42; 162/43; 162/44; 162/90

(58) Field of Classification Search ..... 162/17–19, 162/38, 41–45, 91–92, 94–99, 26–29, 90; 210/724; 423/DIG. 3
See application file for complete search history.

(56) References Cited

U.S. PATENT DOCUMENTS 1,588,335 A * 6/1926 Puttaert et al. ..... 162/90
1,757,768 A * 5/1930 Gortner et al. ..... 162/100
1,758,655 A * 5/1930 Dorner ..... 162/16
1,879,503 A * 9/1932 Rinman ..... 162/10
2,560,638 A * 7/1951 Dreyfus ..... 162/25
4,199,399 A * 4/1980 Villavicencio ..... 162/85
4,331,507 A * 5/1982 Roberts ..... 162/29
4,504,356 A * 3/1985 Mulder et al. ..... 162/29
4,957,599 A * 9/1990 Chou et al. ..... 162/78
5,198,074 A * 3/1993 Villavicencio et al. ..... 162/15
5,547,543 A 8/1996 Nykanen et al. ..... 162/31
6,183,598 B1 * 2/2001 Myreen ..... 162/29
6,258,207 B1 7/2001 Pan ..... 162/27
6,302,997 B1 10/2001 Hurter et al. ..... 162/65
6,632,327 B1 * 10/2003 Shall ..... 162/29
2003/0217823 A1 * 11/2003 Zhu et al. ..... 162/20

* cited by examiner

*Primary Examiner*—Eric Hug
(74) *Attorney, Agent, or Firm*—Bennett Jones LLP

(57) ABSTRACT

A process for removing silica from nonwood plant materials involving both chemical and mechanical action is described. The silica-rich epidermal cells are liberated mechanically by a pre-pulping and low-consistency refining step and subsequently removed from the pulp via the filtrate of a thickening step. Amorphous silica is liberated chemically by using an alkaline dilution source in the pulper, then removed from the pulp via the filtrate of a thickening step and a dewatering step. The silica is then removed from the filtrate by adjusting the pH, followed by a separation step. The desilicated fibrous material may then be chemically or mechanically pulped and bleached using known processes. The silica removed from the nonwood plant material may then be used as a feedstock for other applications.

5 Claims, 1 Drawing Sheet

CHEMIMECHANICAL DESILICATION OF NONWOOD PLANT MATERIALS

This is a Non-Provisional of U.S. application Ser. No. 60/481,340, filed Sep. 8, 2003.

BACKGROUND OF INVENTION

The present invention relates to a chemimechanical process for removing silica from nonwood plant fibre sources.

There is growing interest in using nonwood plant fiber sources, such as wheat straw, flax and hemp, for pulping and papermaking. These and other nonwood lignocellulosic materials can find value-added utilization that would enhance the profitability of farm production.

As wood fiber shortages are predicted in the future, nonwood plants are believed to be a sustainable fiber source to potentially supplement the use of wood fibers in paper applications. Market forces and legal requirements may stimulate the production of paper that contains nonwood plant fibers, as exemplified by experience with recycled fibers.

The art of papermaking was originally developed using nonwood plant sources, whereas the production of pulp and paper from wood is a relatively recent development. Pulping processes can be broadly divided into two large categories: chemical pulping and mechanical pulping. Chemical pulping involves using chemical reactions to solubilize lignin and produce individual fibers or pulp from lignocellulosic raw materials. Within the mechanical pulping category, there are many processes that involve varying combinations of chemical, mechanical and thermal treatments to effect fiber separation, remove some lignin and other chemical components from the original fibers, or increase the brightness or papermaking strength of the resulting fibers. Chemimechanical pulps (CMP) from wood are produced by processes in which the raw material is treated with weak solutions of pulping chemicals such as sulfur dioxide, sodium sulfite, sodium bisulfite or sodium hydrosulfite, followed by mechanical defibration.

One of the problems associated with the chemical pulping of nonwood plants is the difficulty in recovering the cooking chemicals from the spent cooking liquor ("black liquor"), which is a result of the relatively high levels of silica found in most nonwood plant fibers, as compared to wood. During alkaline cooking of nonwood plant fibers, this silica is dissolved and is subsequently removed from the fibers via the black liquor stream, which is sent to the chemical recovery system for conversion into fresh cooking liquor. The silica-laden liquor causes scaling and fouling in evaporators, concentrators and the recovery boilers, resulting in inefficient operation and increased downtime for clean-outs. The inability to recover cooking chemicals from silica-laden black liquor results in increased operating cost and effluent treatment system loading.

Alternatively, mechanical pulping seems to be more suitable for raw materials with higher silica content, particularly wheat and rice straws, since the silica is not dissolved to the same extent as for chemical pulps and will for the most part remain with the fibers throughout the pulping and bleaching process. Mechanical pulping also generates a minimal volume of effluent, thus reducing the environmental impact. However, mechanical pulping generally results in pulp of lower quality. Significant amounts of lignin are left with the mechanical pulp, making it weaker and more difficult to bleach to high brightness than its chemical pulp counterpart.

In U.S. Pat. No. 6,183,598, a process for recovering alkali and heat energy from black liquor is disclosed. The black liquor is the result of a chemical process where the nonwood plant material is heated with an alkaline cooking liquor containing sodium hydroxide. The black liquor contains a significant amount of silicate ions. Recovery of the sodium hydroxide using lime is usually impeded by the formation of calcium silicate, which makes recycling of the lime difficult or impossible. The solution proposed in this patent is to treat the black liquor with carbon dioxide to precipitate silica and lignin. The solids are then removed and the remaining black liquor is evaporated and burnt to generate heat and a sodium carbonate melt, from which carbon dioxide is formed. The carbon dioxide is then reused to treat the black liquor. However, with the precipitation of lignin, there may also be a loss of some inorganics that will limit the potential recovery efficiency. Also, this process is energy intensive because of the heat lost by precipitation of some lignin, which would otherwise be burnt in the recovery boiler to generate steam.

There is still a need in the art for processes which may permit pulping of nonwood plant fibers while allowing chemical recovery despite the high silica content of the fibers.

SUMMARY OF INVENTION

In one aspect, the invention may comprise, in a process for producing pulp from nonwood plant fibers, a chemimechanical desilication process comprising the steps of:

(a) wet pre-pulping the nonwood plant fiber under controlled conditions of temperature, solids content or consistency, and pH;

(b) removing both suspended solids and dissolved solids from the fibrous portion of the pre-pulped material by filtration or dewatering, or filtration and dewatering;

(c) adding acid to the filtrate to force the precipitation of solubilized silica; and (d) removing the silica and other solids from the filtrate, and reusing the filtrate in the pre-pulping step.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

Figure 1:
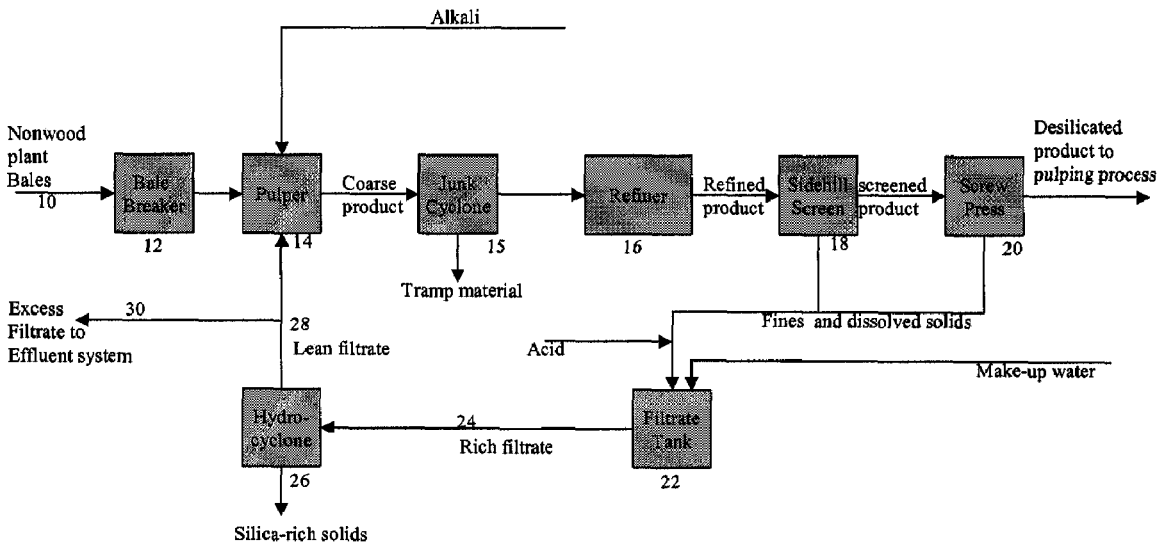
FIG. 1 is a schematic representation of one embodiment of the present invention.

The present invention provides for a method of desilicating material from nonwood plant fibre sources. When describing the present invention, all terms not defined herein have their common art-recognized meanings.

As used herein, the term "nonwood plant fiber" refers to lignocellulosic material which is not derived from wood plants. Nonwood plant fiber sources include, but are not limited to, agricultural residual materials, annual and perennial grasses, and annually harvested fiber crops. Examples of agricultural residuals include wheat straw, rice straw, barley straw, oat straw, corn stover, sugar cane bagasse, oilseed flax straw, and oilseed hemp straw. Examples of annual and perennial grasses include reed canary grass, rye grass, reed grass, switchgrass, and fescue. Examples of annually harvested fiber crops include fiber flax, fiber hemp and kenaf.

In one embodiment, the invention comprises a pre-pulping process, which may be followed by acid treatment and bleaching stages. The pre-pulping process is intended to liberate and remove much of the silica which may be present in the nonwood plant material. The following description describes the method in terms of wheat straw, however, one skilled in the art will recognize that the method may also be applicable to other nonwood plant fibers as well.

In general terms, the pre-pulping stage is used to prepare and desilicate the material prior to a conventional pulping process. It is believed that pulp of acceptable quality may then be produced with less impact on the environment and lower chemical and energy costs. The process incorporates chemical and mechanical action in the same unit operation. The mechanical action liberates the portions of the straw that contain a large percentage of the total silica present in the straw (including the epidermis and nodal material), and the chemical action dissolves the silica that is distributed throughout the remainder of the straw. The chemical action occurs when an alkali solution, such as the weak black liquor generated in a subsequent alkaline pulping stage, is added to the dilution of the pulper and refiner. This action will preferably occur under conditions of controlled consistency, temperature and pH or alkalinity.

The first step is to mechanically liberate the epidermal layer and nodal material of the wheat straw using a mechanical pulping device. In a preferred embodiment, the mechanical action may occur in two steps that may include a pulper to reduce the size of the coarse particles emanating from a pre-cutting stage and to begin the liberation of the epidermis and nodal material, and a low consistency refiner to complete the size reduction and liberation of the epidermis and nodal material. The wheat straw may have been cut and screened prior to this mechanical pulping stage using a dry process such as a disc chipper, forage cutter or tub grinder followed by a screening stage such as a rotary drum screen, vibrating screen or roll type screen. In one embodiment, the wheat straw is pulped at low consistency, for example between about 0.5% and about 6% solids, under mild alkaline conditions (pH 7-11) using a Tornado Pulper™ (Bolton-Emerson Americas Inc.), followed by dewatering or thickening of the pulp. The pH is maintained within the target range by using weak black liquor, which is recovered from a subsequent stage as described below, as the dilution source in the mechanical pulping stage. Cloudy whitewater, acid filtrate, fresh alkali, or fresh acid may also be used in controlling pH.

Thickening removes both the silica-laden fines and the soluble silica that reports to the filtrate stream as a result of alkaline dissolution. As used herein, "fines" means material that passes through a 150-mesh screen. Once the filtrate has been removed, its pH is reduced in order to precipitate soluble silica. The precipitated silica may then be removed using gravity settling, centrifugal action or filtration. The filtrate may then be returned to the system for reuse as dilution to the mechanical pulping stage.

The pre-pulped and desilicated material may then be processed using well-known and standard pulping and bleaching techniques. For example, suitable techniques are described in U.S. Pat. Nos. 6,302,997 and 6,258,207.

A schematic of a desilication pre-pulping process is shown in FIG. 1. Baled plant material (10) is brought into the process. The bale breaker (12) separates the bales into manageable pieces, either with particle size reduction (for example, using a forage cutter) or without size reduction (for example, using a simple mechanical wedge) for addition to the pulper (14). In the pulper (14), the particle size is reduced and the removal of the silica-rich components of the straw substantially begins. Material that passes forward through the pulper (14) is processed in a junk cyclone (15) to remove large tramp material such as rocks and metal prior to refining. The plant material is then refined at low consistency in a refiner (16), where the mechanical liberation of the epidermis and nodes is substantially completed. After refining, material is passed through a sidehill screen (18), where water is removed from the fiberized suspension along with the epidermis and nodal material. The size of the liberated epidermal material is such that it is able to pass through the sidehill screen with the filtrate. Further dewatering occurs in a press (20), which may be a screw press, belt filter press or similar dewatering device.

The pH and temperature of the pulper may be controlled to conditions optimum for the removal of silica. The preferred conditions are a temperature between 50 degrees Celsius and 90 degrees Celsius, and a pH of between 7 and 12. As used herein, "silica" refers to both silica found in the epidermis and nodal material, which may be mechanically liberated and removed, and silica that may be solubilized under the preferred process conditions.

The filtrate of both the sidehill screen and dewatering press will be rich in silica. It passes to a filtrate tank (22) where it may be mixed with whitewater from subsequent processing stages.

The silica-rich filtrate (24) may then be pH-adjusted to precipitate soluble silicate ions, and then processed in a hydrocyclone (26) system to remove suspended solids and the precipitated silica. The lean filtrate (28) may then be reused as dilution to the pulper (14) and low consistency refiner, with make-up water coming from the aforementioned sources.

Surplus water (30) in this loop may be directed to the effluent treatment system for further treatment. Treatment may include settling or flotation for suspended solids removal, and aerobic or anaerobic treatment for removal of dissolved and colloidal organic materials, or combination of these treatments.

The precipitated silica may itself be a useful or valuable product and may be used in other industrial applications or processes. This ability to recover and reuse the silica may enhance the economics of a non-wood fiber processing facility.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A process for desilicating nonwood plant fibers comprising:

(a) wet pre-pulping the nonwood plant fiber under controlled conditions of temperature, solids content, and with sufficient alkali to bring the pH within a pH range of 7 to about 11 and less than that required to dissolve all silica present in the fiber;

(b) removing both suspended solids and dissolved solids from the fibrous portion of the pre-pulped material by filtration or dewatering, or filtration and dewatering;

(c) adding acid to the filtrate to force the precipitation of solubilized silicate; and (d) removing the silica and other solids from the filtrate, and reusing the filtrate in the pre-pulping step.

2. The process of claim 1 wherein the resulting nonwood plant fibers is subsequently pulped chemically and/or mechanically, then bleached.

3. The process of claim 1 wherein the precipitated silica is used as a raw material for other applications.

4. The process of claim 1 wherein the fiber is wet pre-pulped at a temperature of about 50° C. to about 90° C.

5. The process of claim 1 wherein the fiber is wet pre-pulped to a solids content of about 0.5% to 6.0% solids.

* * * * *